US008002570B2

(12) United States Patent
Matsumura et al.

(10) Patent No.: US 8,002,570 B2
(45) Date of Patent: Aug. 23, 2011

(54) RESIN MOLDED PARTS WITH LOCK ARM, CONNECTOR USING IT AND METHOD FOR FORMING RESIN MOLDED PARTS WITH LOCK ARM

(75) Inventors: Kaoru Matsumura, Makinohara (JP); Kazuto Ohtaka, Makinohara (JP); Hideki Homma, Tokyo (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/715,002

(22) Filed: Mar. 1, 2010

(65) Prior Publication Data

US 2010/0227495 A1 Sep. 9, 2010

(30) Foreign Application Priority Data

Mar. 3, 2009 (JP) ..... P2009-049615

(51) Int. Cl.
*H01R 13/64* (2006.01)

(52) U.S. Cl. ..... 439/374; 439/352; 439/141

(58) Field of Classification Search ..... 439/140–141, 439/374, 352, 357; 200/295
See application file for complete search history.

(56) References Cited

U.S. PATENT DOCUMENTS

| | | | | |
|---|---|---|---|---|
| 4,572,602 | A * | 2/1986 | Rupnik | 439/350 |
| 5,383,794 | A * | 1/1995 | Davis et al. | 439/352 |
| 5,501,606 | A * | 3/1996 | Oda et al. | 439/140 |
| 6,409,525 | B1 * | 6/2002 | Hoelscher et al. | 439/140 |
| 6,824,416 | B2 * | 11/2004 | Di Mascio | 439/352 |
| 7,828,583 | B2 * | 11/2010 | Ohsumi et al. | 439/374 |
| 2003/0119349 | A1 * | 6/2003 | Bakker et al. | 439/140 |
| 2005/0059280 | A1 * | 3/2005 | Hobbs et al. | 439/140 |
| 2010/0099295 | A1 * | 4/2010 | Ohsumi et al. | 439/374 |

FOREIGN PATENT DOCUMENTS

| | | |
|---|---|---|
| JP | 04-209479 | 7/1992 |

* cited by examiner

*Primary Examiner* — Renee S Luebke
*Assistant Examiner* — Larisa Z Tsukerman
(74) *Attorney, Agent, or Firm* — Finnegan, Henderson, Farabow, Garrett & Dunner, L.L.P.

(57) ABSTRACT

In resin molded parts with lock arms, a peripheral wall 12*a* protruding toward a rear side vertical to a main body part is connected to the peripheral edge of the substantially plate shaped main body part 12. Belt plate shaped lock arms 13 are connected to the peripheral wall with ends protruding toward a front side vertical to the main body part by connecting base ends 13*a* to the outer surfaces of the peripheral wall. The lock arms have slits 17 which are formed in intermediate parts of the lock arms in the direction of width of the lock arms and continuously extend from the end faces of the base ends of the lock arms to parts before the ends to ensure engaging parts 14 in the ends of the lock arms. When the resin molded parts with the lock arms is formed, the main body part and the lock arms are formed by opening and closing metal molds from a front surface side and a rear surface side of the main body part, the lock arms are formed so as to have shapes more obliquely curved outward toward the ends of the lock arms and the slits are formed by a slit forming part provided in the metal mold of the rear surface side.

2 Claims, 16 Drawing Sheets

RESIN MOLDED PARTS WITH LOCK ARM, CONNECTOR USING IT AND METHOD FOR FORMING RESIN MOLDED PARTS WITH LOCK ARM

BACKGROUND OF THE INVENTION

1. Technical Field

The present invention relates to resin molded parts with a lock arm having a substantially plate shaped main body and a lock arm connected to a peripheral edge of the main body so as to protrude in the vertical direction of the main body, for instance, resin molded parts with lock arms used as movable guide members of a connector to which the movable guide member (parts called a "terminal deformation preventing member" or a "moving plate") is attached to protect a protruding end of a male terminal in the inner part of a hood part of a female type connector in which the male terminal is accommodated until the female type connector is fitted to a male type connector and guide a connection to a female terminal thereto, a connector using the resin molded parts with the lock arm as the movable guide member and a method for forming the resin molded parts with the lock arm.

2. Description of the Related Art

Multi-polar connectors in which many small male terminals are incorporated include a connector to which a movable guide member (a moving plate) is attached to protect the protruding ends of the male terminals and guide a connection of mate female terminals in an inner part of a hood part for receiving a mate connector until the male terminals are fitted to the female terminals of the mate connector.

FIGS. 20 and 21 are explanatory views of this kind of a usual connector disclosed in, for instance, patent literature 1.

As shown in FIG. 20, this connector includes a male type connector 101, a female type connector 102 having a hood part 102A for receiving the male type connector 101 and a movable guide member 103 accommodated in the hood part 102A so as to slide in the moving direction of the male type connector 101 to protect and guide male terminals protruding in the hood part 102A from the female type connector 102.

The movable guide member 103 has a plate shaped main body part 104 in which through holes 105 corresponding to the number of male terminals are provided. At both ends in the longitudinal direction of the plate shaped main body part 104, lock arms 110 protrude that extend substantially vertically to the main body part 104. In the lock arms 110, slits 112 are formed that extend in the fitting direction of the connector. Thus, engaging parts 113 are ensured in the end parts of the lock arms 110.

As shown in FIG. 21(*a*), the engaging parts 113 of the ends of the lock arms 110 are fitted to parts between first protrusions 114 and second protrusions 115 provided in an inner wall of the hood part 102A so that the movable guide member 103 is temporarily engaged with the hood part.

On outer sidewalls of the male type connector 101, third protrusions 116 are provided that can be fitted in sliding to the slits 112 of the lock arms 110. When both the connectors 101 and 102 are fitted to each other, as shown in FIG. 21(*b*), the third protrusions 116 pass through inside the engaging parts 113 of the ends of the lock arms 110, and then, the male type connector 101 presses the movable member 103 in a direction shown by an arrow mark Y. Thus, as shown in FIG. 21(*c*), the temporary engagement of the engaging parts 113 and the second protrusions 115 is disengaged so that the movable member 103 may be pressed and moved to the direction shown by the arrow mark Y.

In this case, finally, after the engaging parts 113 pass the second protrusions 115, the lock arms 110 finish a role of the temporary engagement to be accommodated in spaces ensured in the rear parts of the second protrusions 115 and restored to original forms.

Further, when the fitted state of both the connectors 101 and 102 is released, as shown in FIG. 21(*c*), when the male type connector 101 is moved in the direction shown by an arrow mark Z, the third protrusions 116 of the male type connector 101 press the engaging parts 113 to go over the second protrusions 115. As shown in FIG. 21(*d*), under a state that the engaging arts 113 are located between the first protrusions 114 and the second protrusions 115, the third protrusions 116 of the male type connector 101 pass through inside the engaging parts 113 of the lock arms 110. Thus, the male type connector 101 is pulled out from the hood part 102A. However, since the engaging arts 113 of the lock arms 110 are held between the first protrusions 114 and the second protrusions 115, the movable guide member 103 is held in a temporarily engaged state at that position.

In the movable guide member 103 of the connector, the slits 112 of the above-described lock arms 110 are formed in rectangular holes passing through in the vertical directions (rightward and leftward) to the extending directions of the lock arms 110. Thus, a necessary accuracy of inner end faces of the engaging parts 113 of the ends of the lock arms 110 are ensured.

Patent literature 1: JP-A-4-209479

The slits 112 of the lock arms 110 in the above-described movable member 103 correspond to parts called undercuts in molding with a resin.

Ordinarily, when parts that includes a substantially plate shaped main body part and arm shaped protrusions formed on peripheral edges which protrude in the vertical direction of the main body part is molded with a resin, the parts is formed by opening and closing forward and backward a combination of a metal mold of a front surface side that forms the front surface side of the main body part and a metal mold of a rear surface side that forms the rear surface side.

However, when the arm shaped protrusions have undercut parts like the slits 112 passing through rightward and leftward as in the above-described lock arms 110, since the slits 112 as the undercut parts cannot be formed only by the metal mold of the front surface side and the metal mold of the rear surface side, a slide core moving rightward and leftward is ordinarily used as well as the metal mold of the front surface side and the metal mold of the rear surface side to form the slits.

However, when such a slide core is used, since the structure of the metal mold is complicated, the cost of a molded product is inconveniently high.

SUMMARY OF THE INVENTION

The present invention is proposed by considering the above-described circumstances and it is an object of the present invention to provide resin molded parts with lock arms in which the lock arms having slits can be formed by avoiding undercuts, a connector using the resin molded parts as a movable member and a method for forming the resin molded parts with lock arms.

A first aspect of the invention is resin molded parts, comprising a main body part, and belt plate shaped lock arms, connected to peripheral edges of the main body part with base ends connected to the peripheral edges of the main body part and ends protruding toward a front side vertical to the main body part, the lock arms having slits which are formed in intermediate parts of the lock arms in the direction of width of the lock arms and extend from the base ends of the lock arms to parts before the ends to ensure engaging parts in the ends of the lock arms; wherein a peripheral wall protruding toward a rear side vertical to the main body part is connected to the peripheral edge of the main body part, the lock arms are connected to the outer surfaces of the peripheral wall by connecting the base ends to the outer surfaces of the peripheral wall and the slits are continuously formed from the end faces of the base ends of the lock arms to the parts before the ends of the lock arms.

According to the invention defined in the first aspect of the invention, the slits are formed from end faces of base ends of the lock arms to parts before the ends of the lock arms. Thus, undercuts at the time of forming the slits are eliminated. Namely, generally, when parts that includes a substantially plate shaped main body part and lock arms provided on peripheral edges of the main body part which protrude in the vertical direction of the main body part is molded with a resin, the parts is formed by opening and closing forward and backward a combination of a metal mold of a front surface side that forms the front surface side of the main body part and a metal mold of a rear surface side that forms the rear surface side. However, when the slits passing through rightward and leftward are formed as in the above-described lock arms, since the slits serve as the undercut parts, the slits as the undercut parts cannot be formed only by the metal mold of the front surface side and the metal mold of the rear surface side. A slide core moving rightward and leftward is ordinarily used as well as the metal mold of the front surface side and the metal mold of the rear surface side to form the slits. However, when such a slide core is used, the structure of the metal mold is complicated and the cost of a molded product is inconveniently high. Thus, in the invention according to claim 1, the slits are continuously formed from the end faces of the base ends of the lock arms to the parts before the ends of the lock arms to eliminate the undercuts. Accordingly, a slit forming part is formed in the metal mold of the rear surface side, so that the slits may be formed only by the forward and backward movement of the metal mold of the front surface side and the metal mold of the rear surface side. Thus, the structure of the meal mold can be prevented from being complicated. As a result, the cost of the molded product can be lowered.

A second aspect of the invention is a connector, comprising a male type connector in which female terminals are incorporated; a female type connector having male terminals incorporated which are connected to the female terminals and a hood part for receiving the male type connector in a front part; and a movable guide member accommodated in the hood part and configured to slide in a moving direction of the male type connector, located at an initial position in a front side before the male type connector is fitted to the female type connector to protect protruding ends of the male terminals; and pressed by the male type connector to move to a rear side as the male type connector is fitted to the female type connector to guide the connection of the male terminals to the female terminals in the male type connector, wherein the movable guide member is provided with lock arms having slits, first engaging parts are provided on the wall surfaces of the hood part of the female type connector that are engaged with the lock arms to prevent the movable guide member from being detached from the female type connector and second d engaging parts are provided in the male type connector that are engaged with the slits of the lock arms, and the resin molded parts according to the first aspect of the invention is used as the movable guide member.

Further, according to the invention defined in the second aspect of the invention, since the resin molded parts of the invention defined in the first aspect of the invention is used as the movable guide member, the cost of the connector can be lowered.

A third aspect of the invention is the method for forming the resin molded parts according to the first aspect of the invention, the method including the steps of: forming the main body part and the lock arms by opening and closing metal molds from a front surface side and a rear surface side of the main body part; forming the lock arms so as to have shapes more obliquely curved outward toward the ends of the lock arms and forming the slits by a slit forming part provided in the metal mold of the rear surface side.

Further, according to the invention defined in the third aspect of the invention, below-described effects can be obtained. Namely, when the resin molded parts according to the first aspect of the invention is formed only by the metal mold of the front surface side and the metal mold of the rear surface side, in order to completely and clearly open the slits by the slit forming part provided in the metal mold of the rear surface side, a butting surface of the metal mold needs to be ensured in the peripheral wall to which the base ends of the lock arms are connected. To ensure the butting surface, since a necessary butting amount needs to be estimated, the peripheral wall to which the base ends of the lock arms are connected may possibly decrease its thickness. When the peripheral wall is partly thinned due to the decrease of the thickness, that part is weak in its strength. Thus, a support force of the lock arms is inconveniently deteriorated.

Thus, in the method for forming the resin molded parts, the lock arms are formed so as to have shapes more obliquely curved outward toward the ends of the lock arms and the slits are formed by the slit forming part provided in the metal mold of the rear surface side.

In such a way, especially, the butting amount necessary for forming the engaging parts of the ends of the lock arms with good accuracy is maintained, and the decrease of the thickness of the peripheral wall for supporting the base ends of the lock arms can be avoided at the same time. Consequently, the deterioration of the support force of the lock arms can be prevented.

DESCRIPTION OF THE PREFERRED EMBODIMENTS

Figure 1:
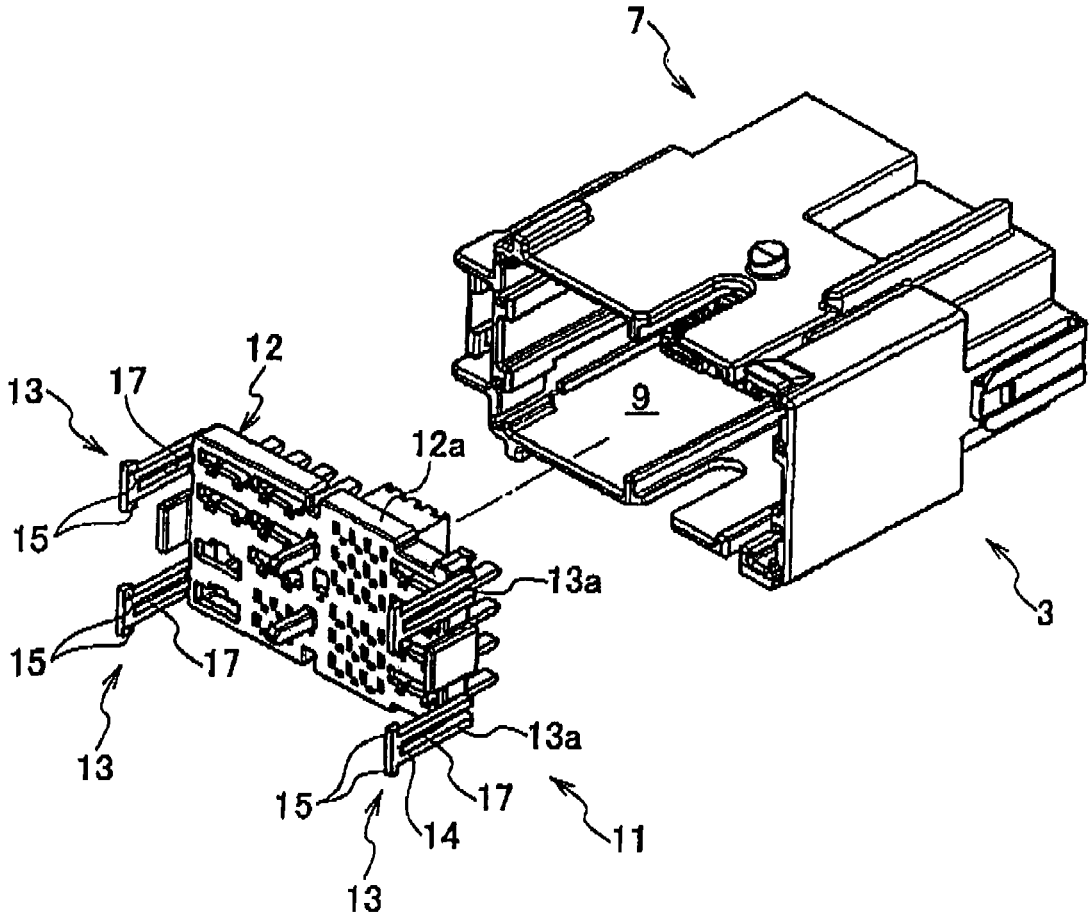
FIG. 1 is a perspective view showing a relation between a movable guide member as resin molded parts with lock arms of an exemplary embodiment of the present invention and a female type connector.

FIGS. 21(*a*) to 21(*d*) are explanatory views respectively showing operating states of a lock arm of the movable guide member in order.

DESCRIPTION OF THE PREFERRED EMBODIMENTS

Now, an exemplary embodiment of the present invention will be described below by referring to the drawings.

Figure 2:
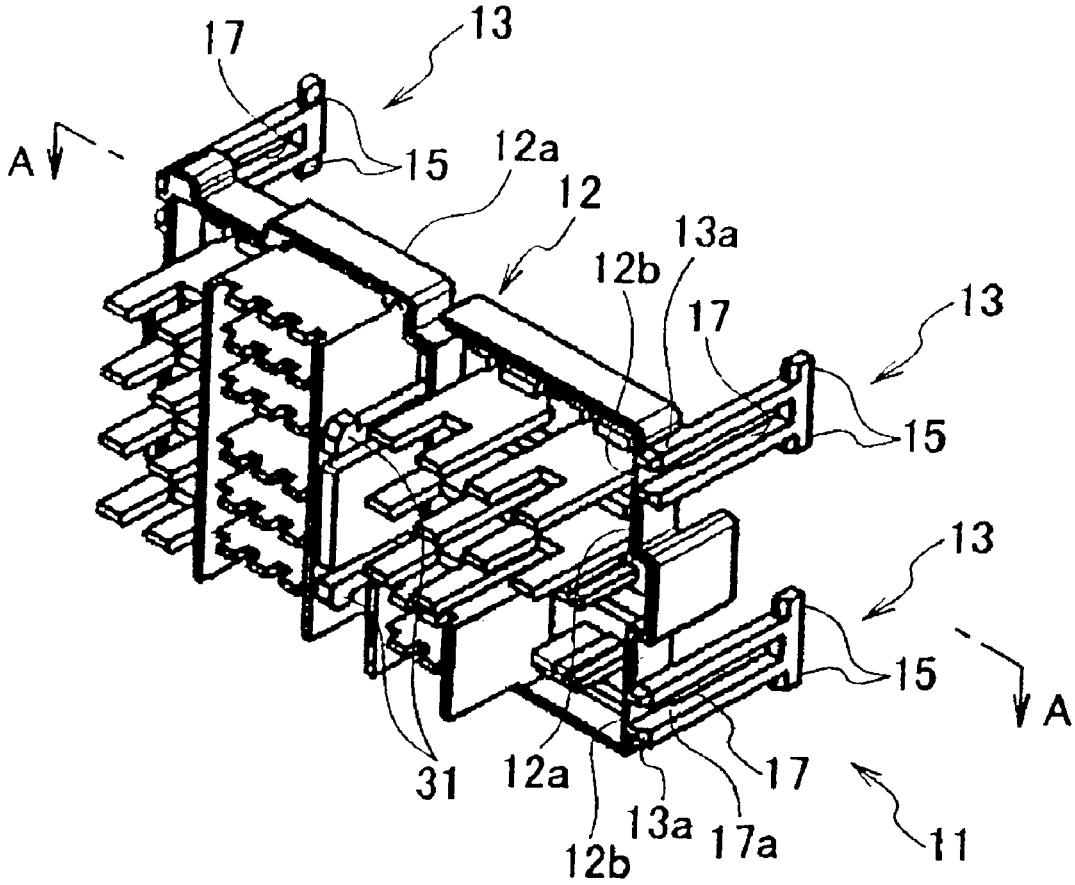
FIG. 2 is a perspective view of the movable guide member shown in FIG. 1 that is seen from an opposite side.
Figure 3:
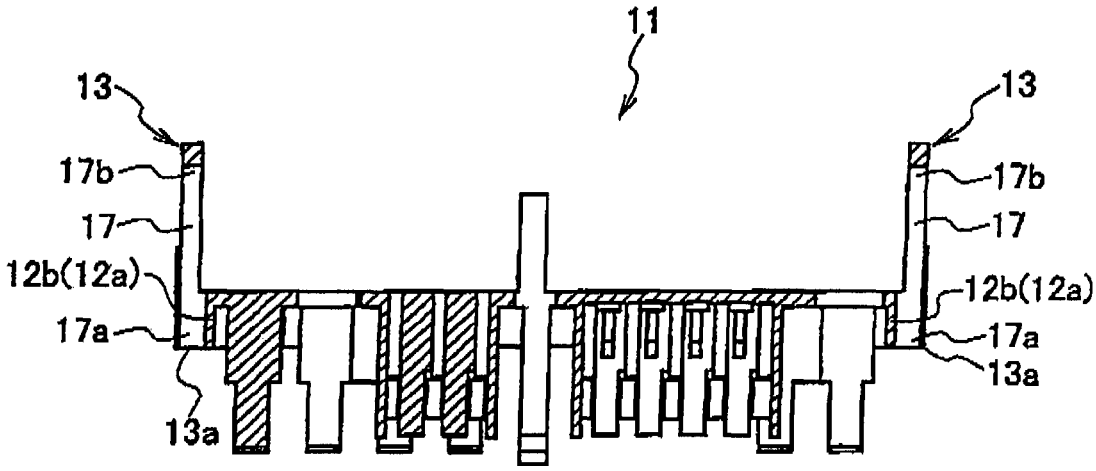
FIG. 3 is a sectional view taken along a line A-A in FIG. 2.
Figure 4:
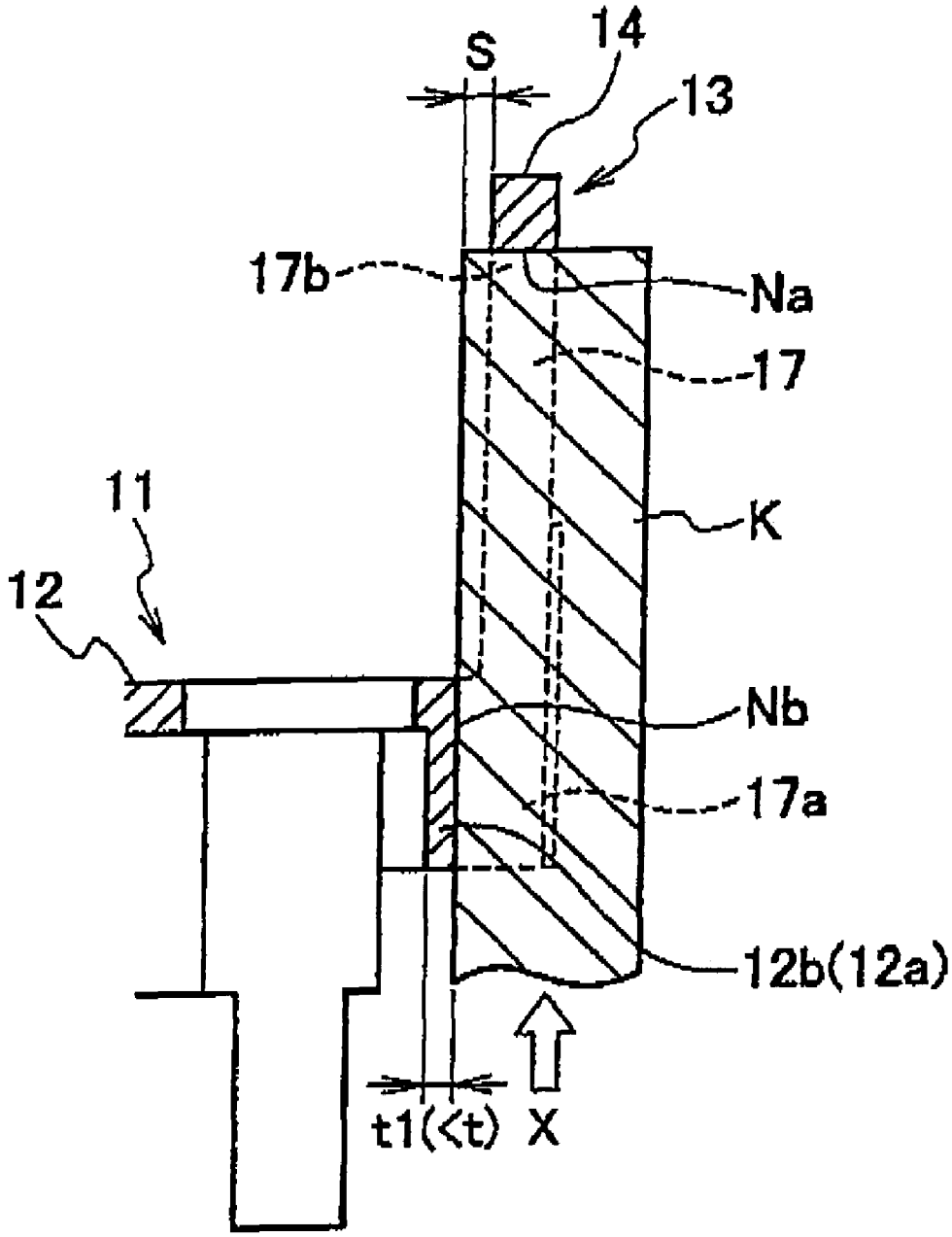
FIG. 4 is a sectional view of main parts showing a relation between a slit forming part of a metal mold when the lock arms of the movable guide member shown in FIG. 3 are formed and a molded product and a diagram for explaining a problem in molding.
Figure 5:
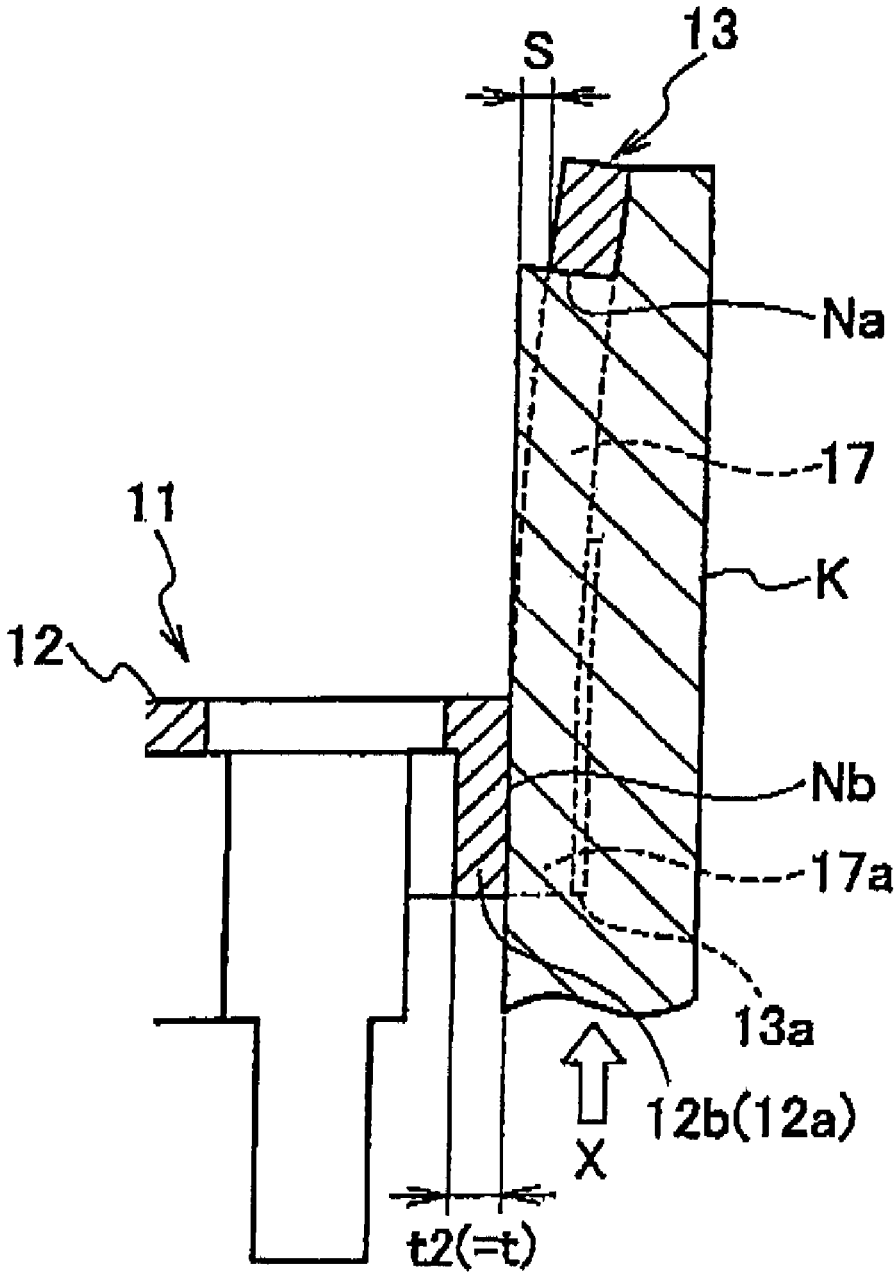
FIG. 5 is an explanatory view of a method for forming resin molded parts with lock arms of the present invention for solving the problem shown in FIG. 4.
Figure 6:
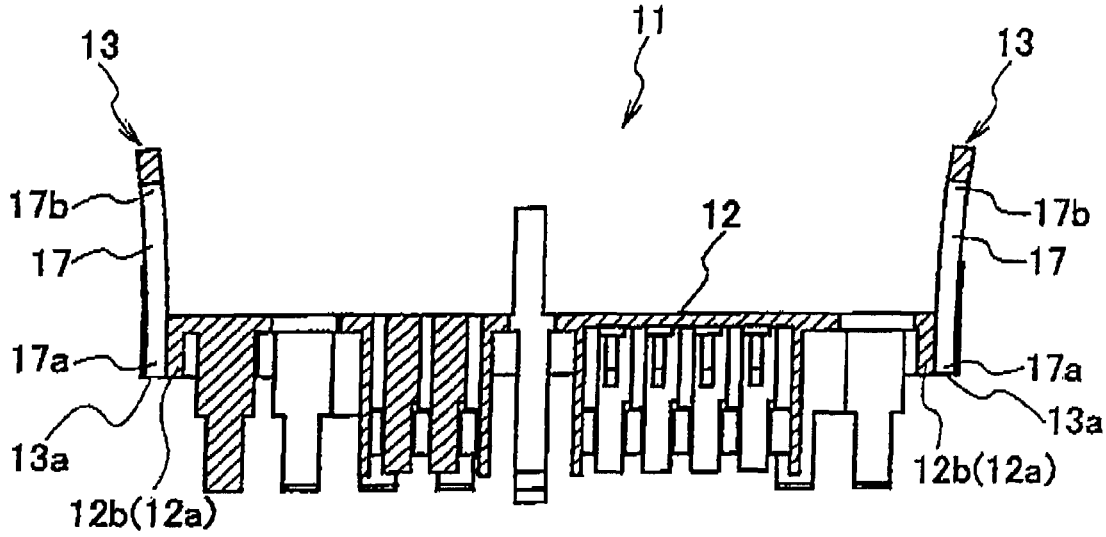
FIG. 6 is a sectional view of the movable guide member formed by the method of FIG. 5, which is similar to FIG. 3.
Figure 7:
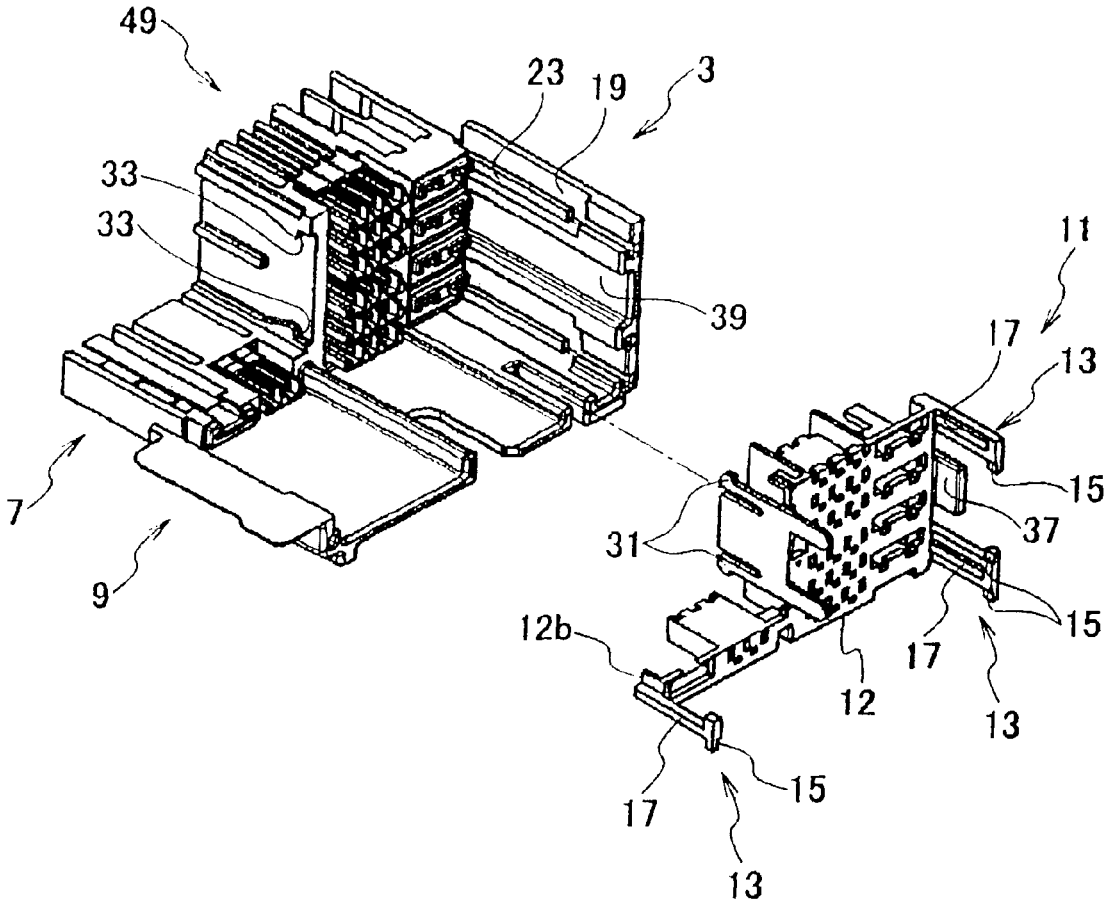
FIG. 7 is a partly broken perspective view showing the relation between the movable guide member and the female type connector.
Figure 8:
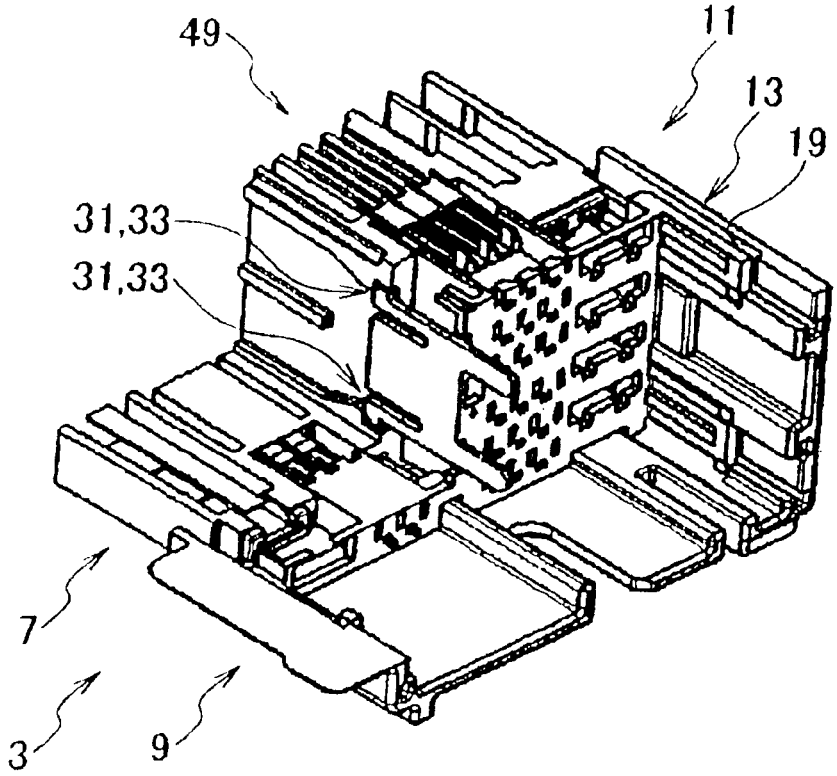
FIG. 8 is a partly broken perspective view showing a state that the movable guide member is accommodated and temporarily engaged in a fitting hood part of the female type connector.
Figure 9:
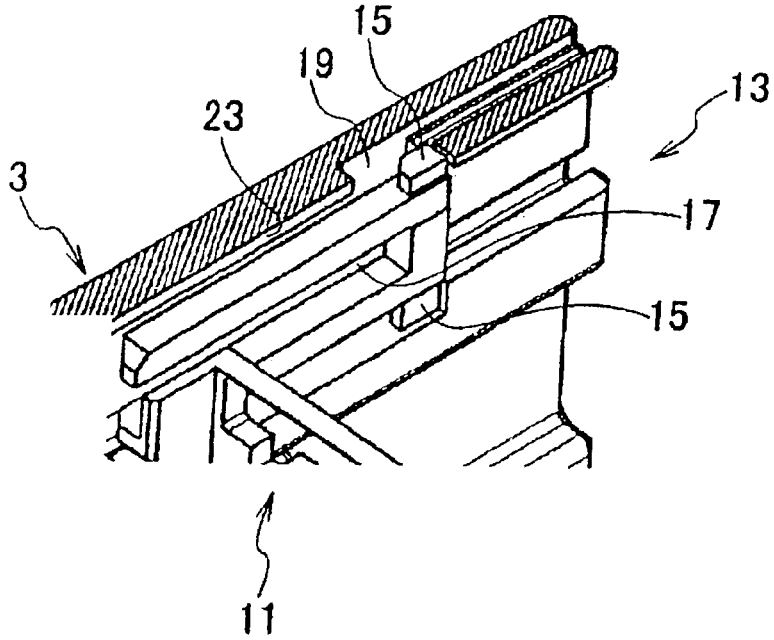
FIG. 9 is an enlarged perspective view of main parts in which the relation of the movable guide member and the fitting hood part that are temporarily engaged is enlarged and shown.
Figure 10:
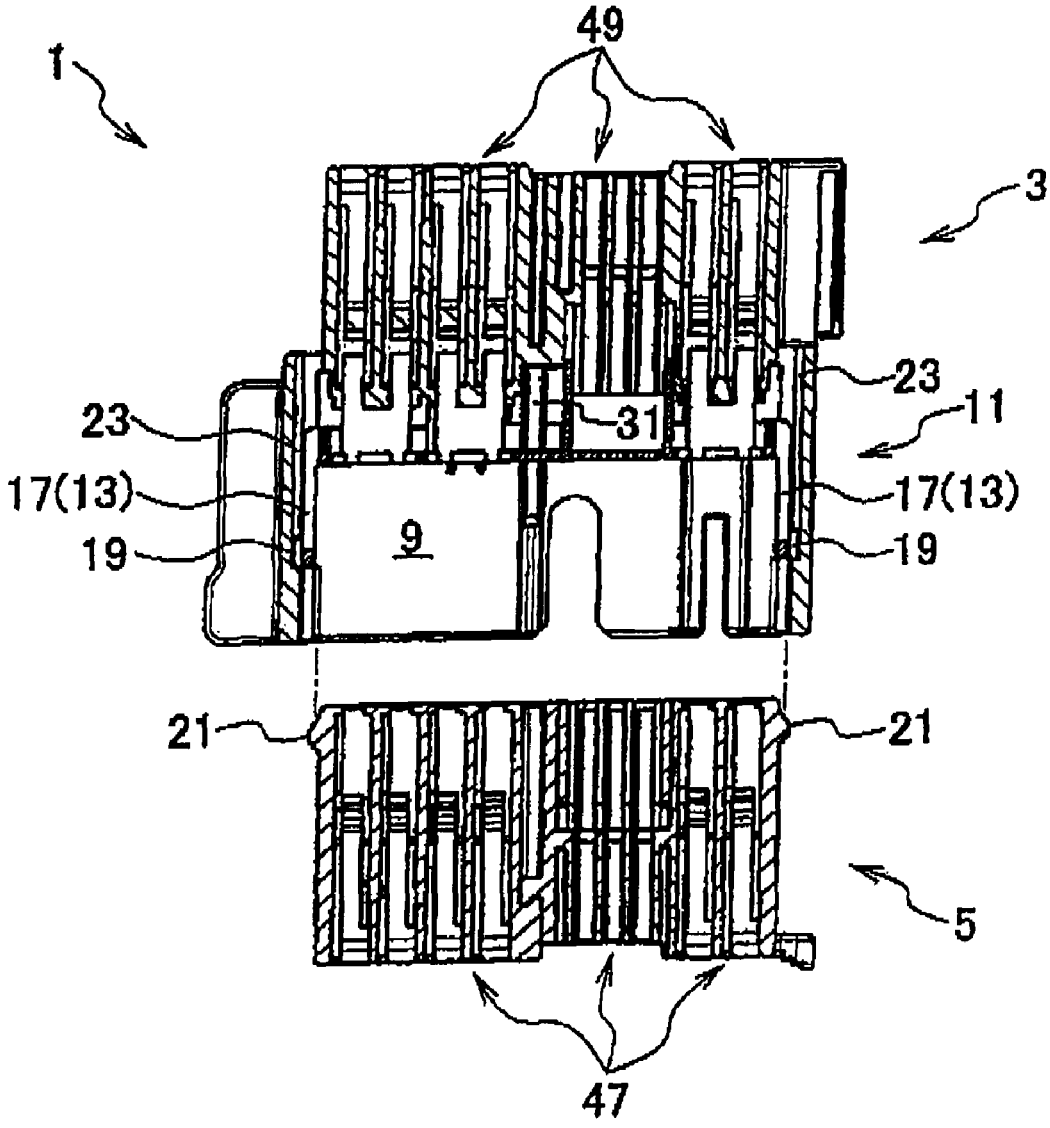
FIG. 10 is a sectional view showing a state before the female type connector having the movable guide member 11 temporarily engaged in the fitting hood part is fitted to a male type connector.

FIG. 1 is a perspective view showing a relation between a movable guide member 11 as resin molded parts with lock arms of an exemplary embodiment of the present invention and a female type connector 3. FIG. 2 is a perspective view of the movable guide member 11 shown in FIG. 1 that is seen from an opposite side. FIG. 3 is a sectional view taken along a line A-A in FIG. 2. FIG. 4 is a sectional view of main parts showing a relation between a slit forming part K of a metal mold when the lock arms 13 of the movable guide member 11 shown in FIG. 3 are formed and a molded product and a diagram for explaining a problem in molding. FIG. 5 is an explanatory view of a method for forming resin molded parts with lock arms of the present invention for solving the problem shown in FIG. 4. FIG. 6 is a sectional view of the movable guide member 11 formed by the method of FIG. 5, which is similar to FIG. 3. FIG. 7 is a partly broken perspective view showing the relation between the movable guide member 11 and the female type connector 3. FIG. 8 is a partly broken perspective view showing a state that the movable guide member 11 is accommodated and temporarily engaged in a fitting hood part 9 of the female type connector 3. FIG. 9 is an enlarged perspective view of main parts in which the relation of the movable guide member 11 and the fitting hood part 9 that are temporarily engaged is enlarged and shown. FIG. 10 is a sectional view showing a state before the female type connector having the movable guide member temporarily engaged in the fitting hood part is fitted to a male type connector.

Figure 11:
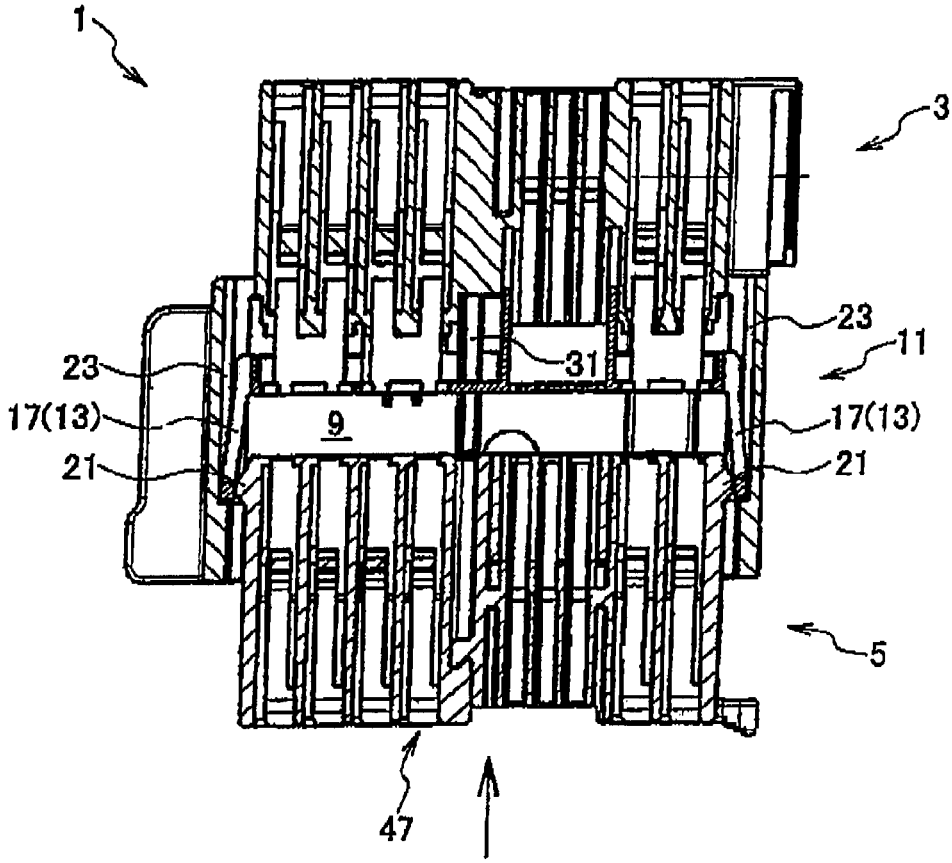
FIG. 11 is a sectional view showing an initial state when the male type connector is fitted to the female type connector, and showing a state that engaging protrusions (second engaging parts) of the male type connector press the lock arms to engage lock arm regulating protrusions with temporary engaging recessed parts (first engaging parts).
Figure 12:
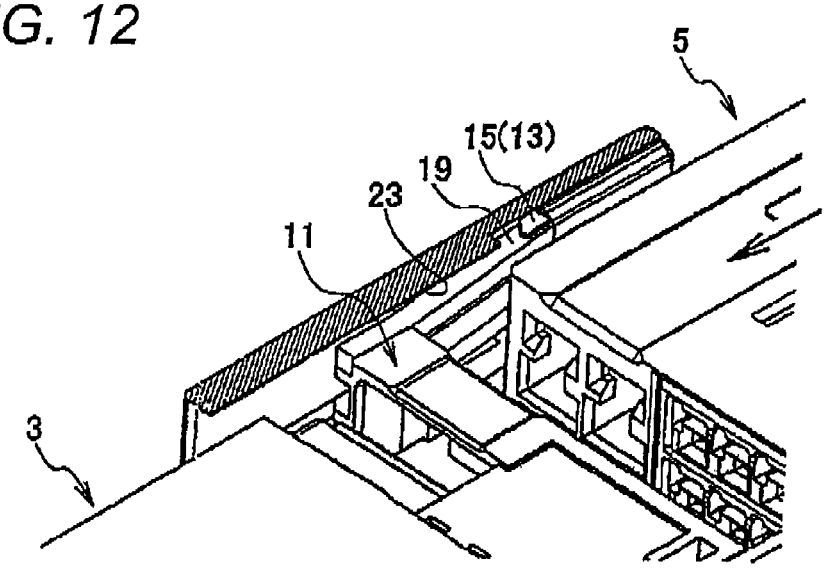
FIG. 12 is an enlarged perspective view of main parts in the state shown in FIG. 11.
Figure 13:
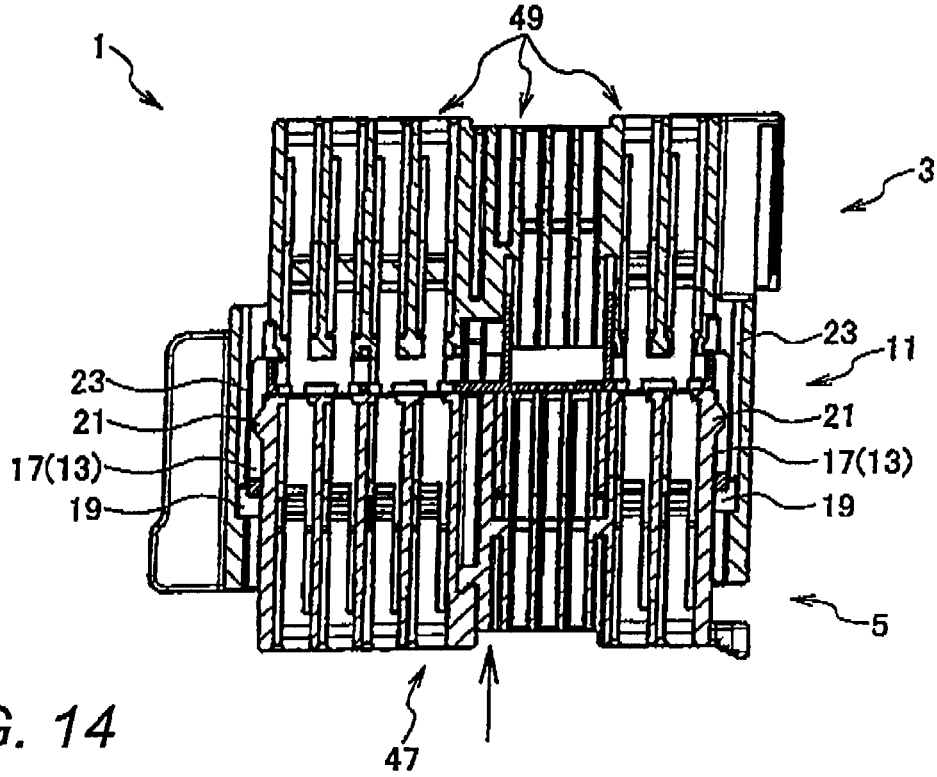
FIG. 13 is a sectional view showing a state that the male type connector is further fitted to the female type connector and showing a state that the male type connector presses the movable guide member to a main engaging position side to advance male terminals to be fitted to female terminals.
Figure 14:
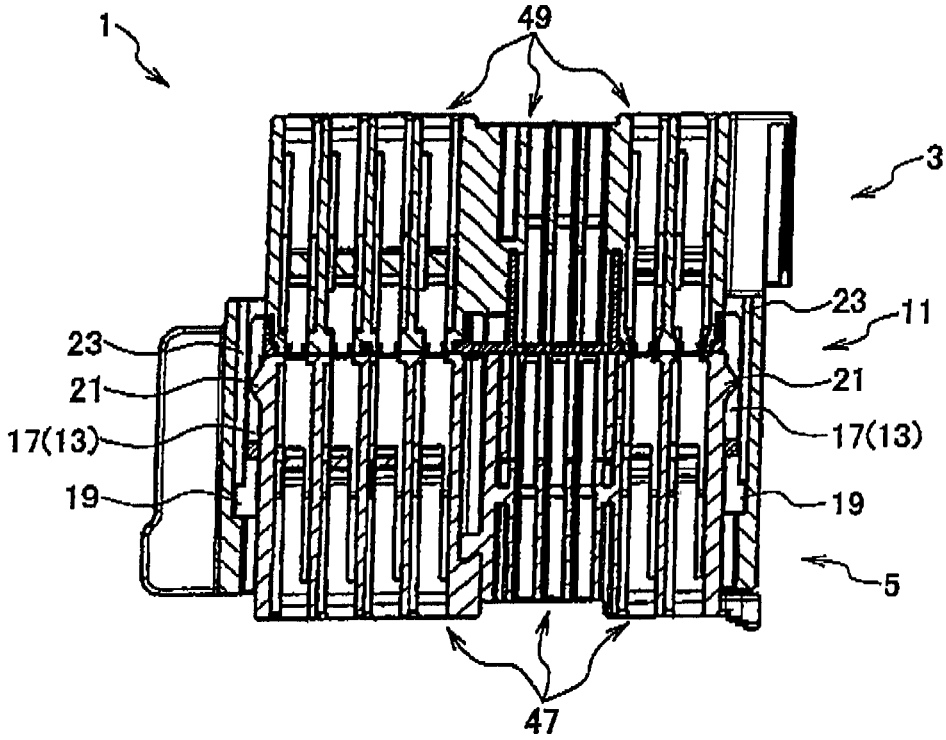
FIG. 14 is a sectional view showing a state when the male type connector is completely fitted to the female type connector.
Figure 15:
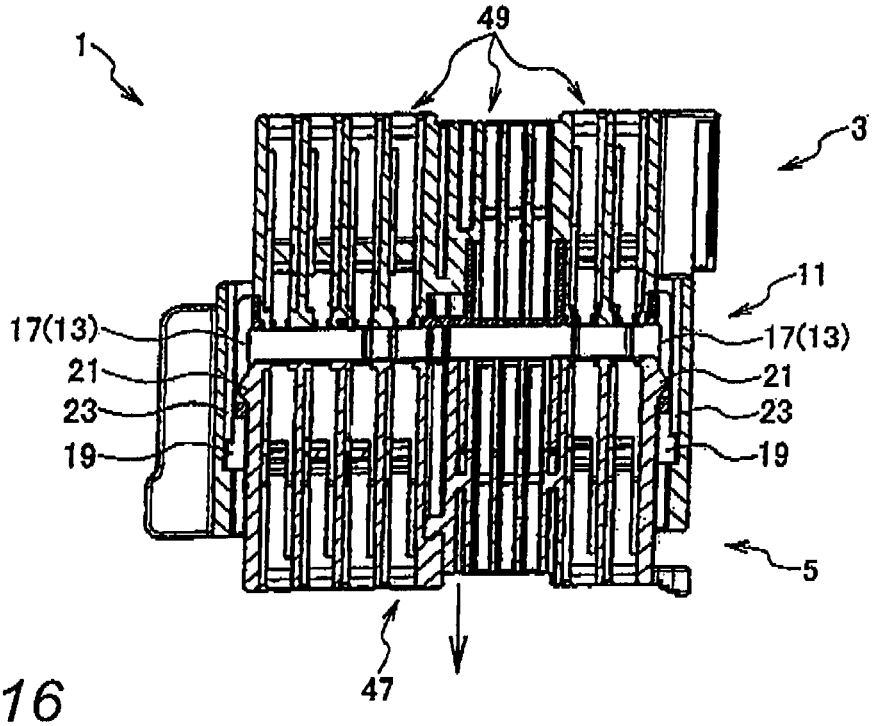
FIG. 15 is a sectional view showing an initial state when the fitted state of the male type connector to the female type connector is released and showing a state that the engaging protrusions of the male type connector are engaged with the slits of the lock arms so that the male type connector moves the movable guide member to a temporary engaging position side.
Figure 16:
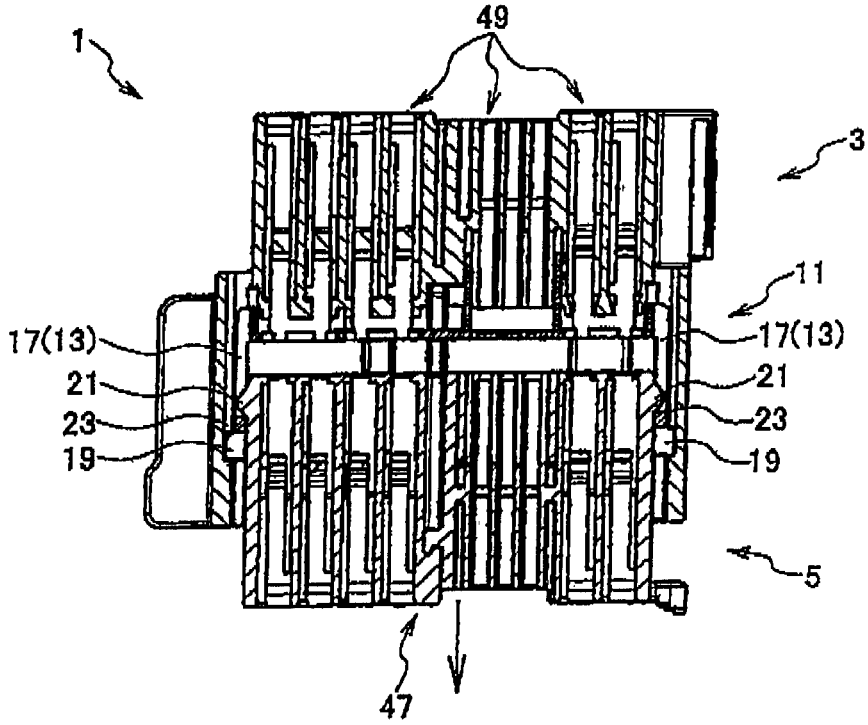
FIG. 16 is a sectional view showing a state that the movable guide member is returned to a part before the temporary engaging position.
Figure 17:
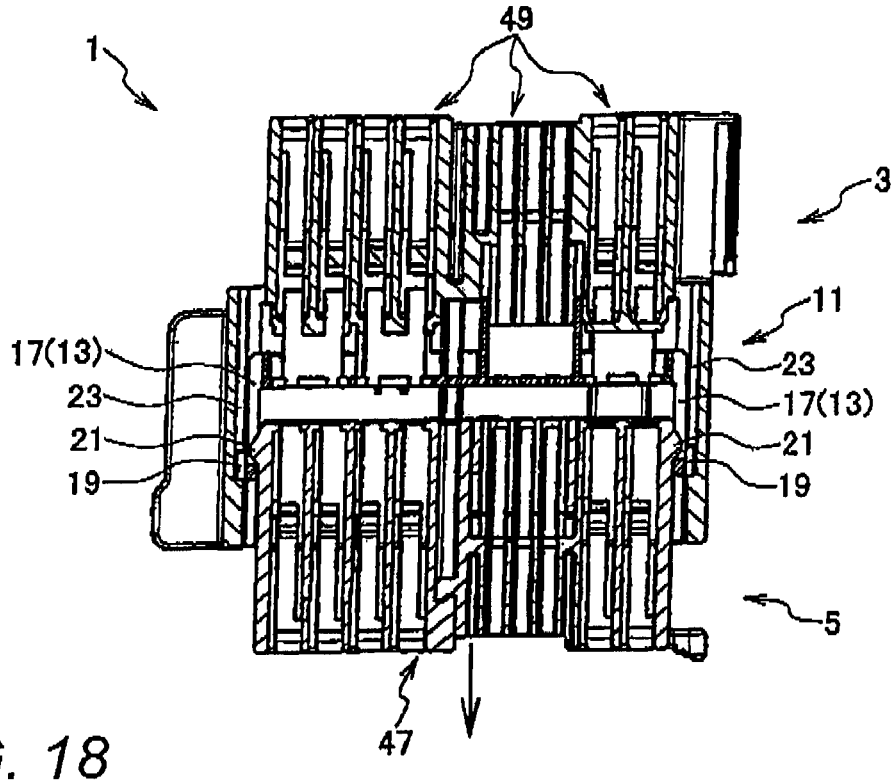
FIG. 17 is a sectional view showing a state that the movable guide member is returned to the temporary engaging position and the engaging protrusions of the male type connector starts to press the lock arms.
Figure 18:
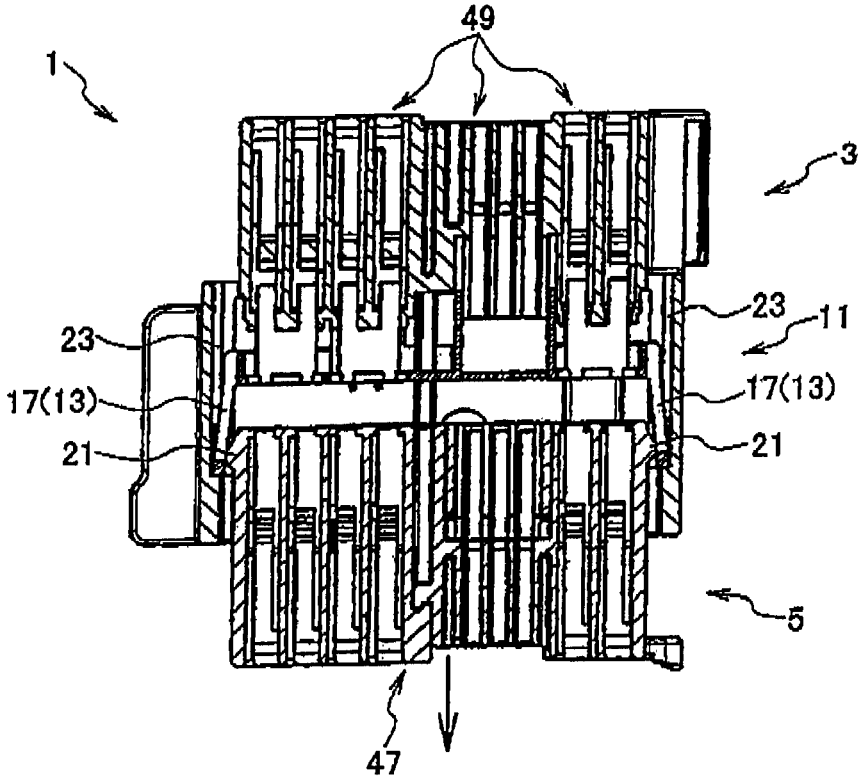
FIG. 18 is a sectional view showing a state that the engaging protrusions of the male type connector press the lock arms to engage the lock arm regulating protrusions with the temporary engaging recessed parts.
Figure 19:
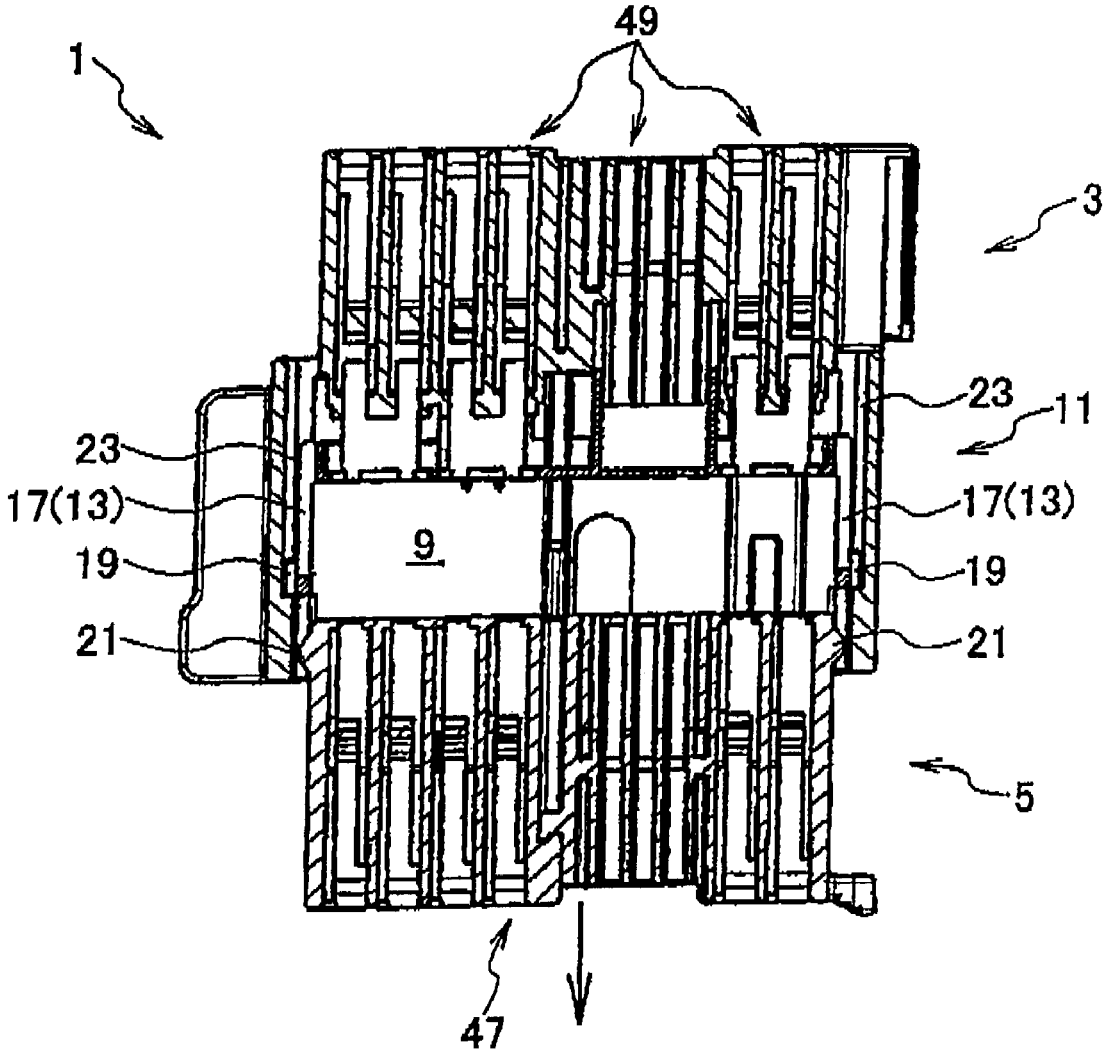
FIG. 19 is a sectional view showing a state that the movable guide member is held in the temporary engaging position by the engagement with the temporary engaging recessed parts and the engagement of the engaging protrusions of the male type connector with the slits of the lock arms is released so that the male type connector moves to an opening side of the fitting hood part.
Figure 20:
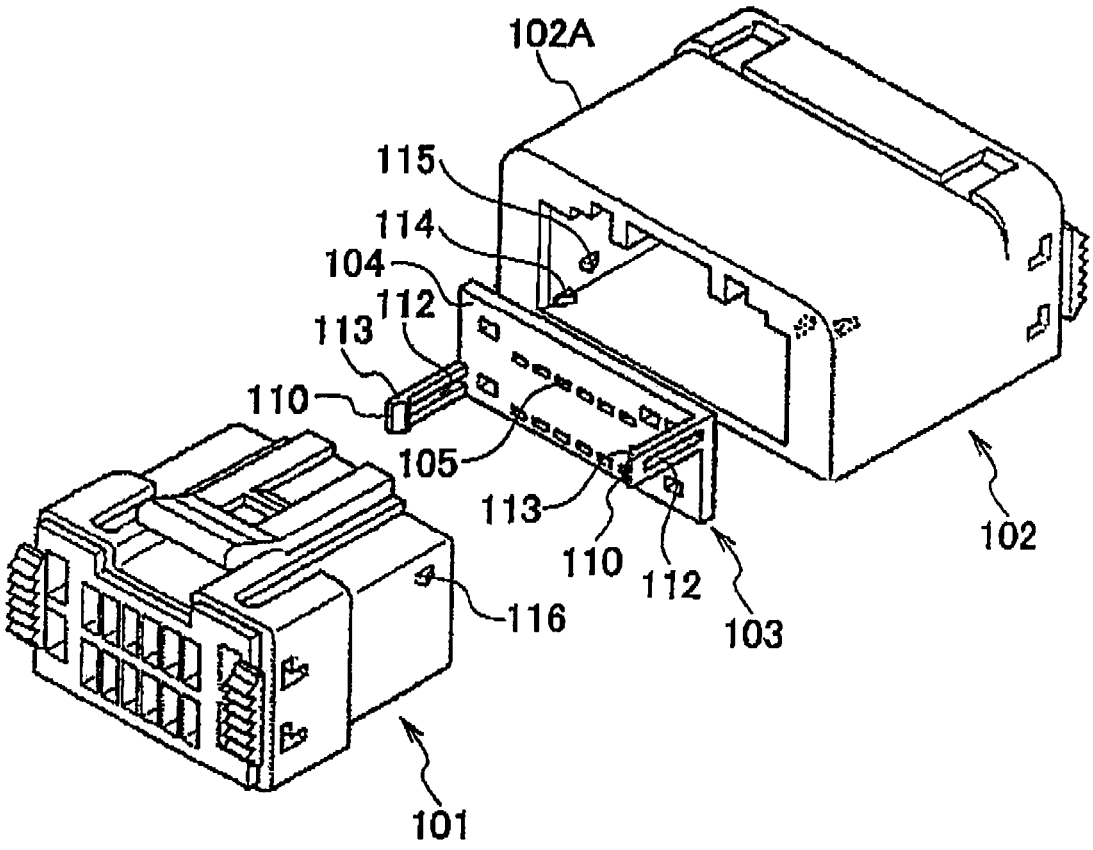
FIG. 20 is an exploded perspective view of a connector including a usual movable guide member (resin molded parts with lock arms).
Figure 21A:
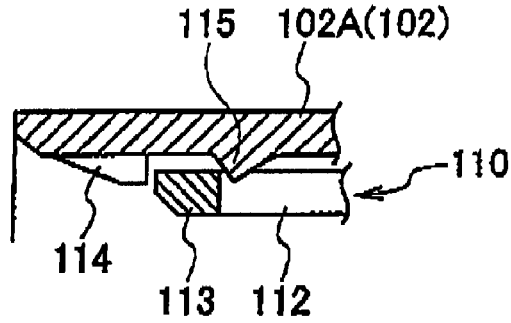
Figure 21B:
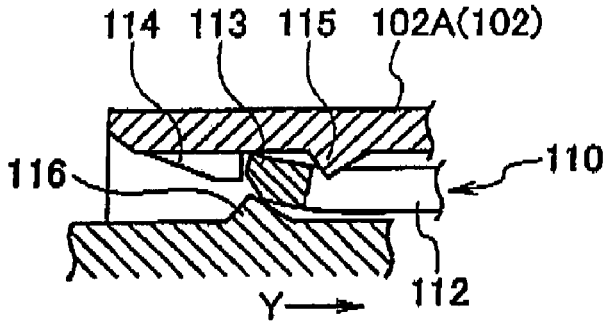
Figure 21C:
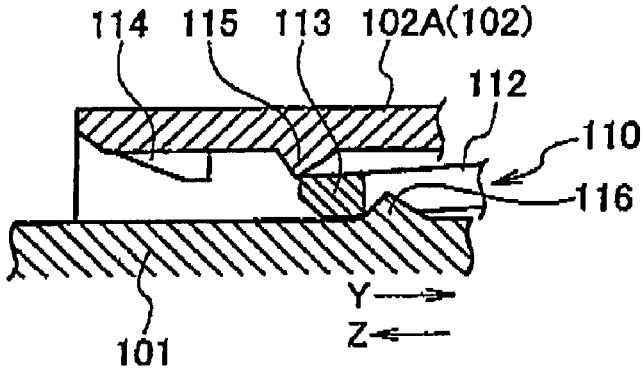
Figure 21D:
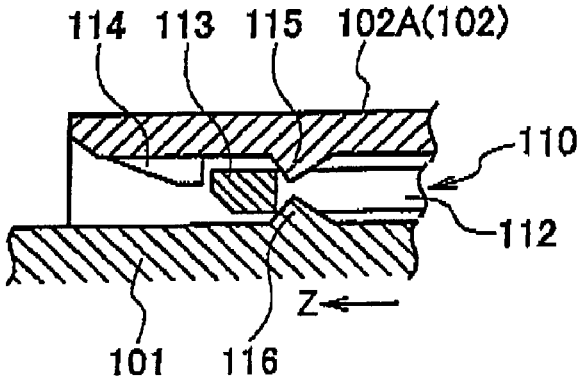

Further, FIG. 11 to FIG. 19 are operation explanatory views when the male type connector 5 is fitted to the female type connector 3 and when a fitted state is released. FIG. 11 is a sectional view showing an initial state when the male type connector 5 is fitted to the female type connector 3, and showing a state that engaging protrusions 21 (second engaging parts) of the male type connector 5 press the lock arms 13 to engage lock arm regulating protrusions 15 with temporary engaging recessed parts 19 (first engaging parts). FIG. 12 is an enlarged perspective view of main parts in the state shown in FIG. 11. FIG. 13 is a sectional view showing a state that the male type connector 5 is further fitted to the female type connector 3 and showing a state that the male type connector 5 presses the movable guide member 11 to a main engaging position side to advance male terminals to be fitted to female terminals. FIG. 14 is a sectional view showing a state when the male type connector 5 is completely fitted to the female type connector 3. FIG. 15 is a sectional view showing an initial state when the fitted state of the male type connector 5 to the female type connector 3 is released and showing a state that the engaging protrusions 21 of the male type connector 5 are engaged with the slits 17 of the lock arms 13 so that the male type connector 5 moves the movable guide member 11 to a temporary engaging position side. FIG. 16 is a sectional view showing a state that the movable guide member 11 is returned to a part before the temporary engaging position. FIG. 17 is a sectional view showing a state that the movable guide member 11 is returned to the temporary engaging position and the engaging protrusions 21 of the male type connector 5 starts to press the lock arms 13. FIG. 18 is a sectional view showing a state that the engaging protrusions 21 of the male type connector 5 press the lock arms 13 to engage the lock arm regulating protrusions 15 with the temporary engaging recessed parts 19. FIG. 19 is a sectional view showing a state that the movable guide member 11 is held in the temporary engaging position by the engagement with the temporary engaging recessed parts 19 and the engagement of the engaging protrusions 21 of the male type connector 5 with the slits 17 of the lock arms 13 is released so that the male type connector 5 moves to an opening side of the fitting hood part 9.

As shown in FIG. 1 and FIG. 10, a connector 1 of the present exemplary embodiment includes a female type connector 3 made of a synthetic resin that includes a connector main body 7 for accommodating male terminals in terminal accommodating chambers 49 and a fitting hood part 9 arranged in a front part of the connector main body 7 and having end parts of the male terminals protruding, the connector main body 7 and the fitting food part 9 being integrally formed, a male type connector 5 made of a synthetic resin that accommodates female terminals in terminal accommodating chambers 47 and can be inserted into the fitting hood part 9 and a movable guide member 11 made of a synthetic resin that can be accommodated in the fitting hood part 9 and can slide between a temporary engaging position where the end parts of the male terminals are supported and aligned with the central positions of the female terminals and a main engaging position where the male terminals are completely fitted to the female terminals.

The movable guide member 11 realizes a function that the movable guide member 11 is located at the temporary engaging position (an initial position) in a front side of the fitting hood part 9 before the male type connector 5 is fitted to the female type connector 3 to protect the protruding ends of the male terminals and a function that the movable guide member 11 is pressed by the male type connector 5 to move to a rear side as the male type connector 5 is fitted to the female type connector 3 to guide a connection of the male terminals to the female terminals in the male type connector 5. The movable guide member 11 corresponds to the resin molded parts with lock arms of the present invention.

In the movable guide member 11, as shown in FIG. 2, to a peripheral edge of a rectangular plate shaped main body part 12, a peripheral wall 12*a* is connected that protrudes toward a rear side vertical to the main body part 12. Base ends 13*a* are connected to the outer surface of the peripheral wall 12*a* so that four belt plate shaped lock arms 13 are connected to the peripheral wall whose ends protrude in a front side vertical to the main body part 12.

In FIG. 2, parts designated by reference numerals 12*b* are parts of the peripheral wall 12*a* to which the base ends 13*a* of the lock arms 13 are connected. The lock arms 13 may be respectively bent to an inner wall side of the fitting hood part 9 on the parts of the peripheral wall 12*a* to which the base ends 13*a* are connected as supporting points. The directions of width of the belt plate shaped lock arms 13 respectively correspond to the direction of a surface of the peripheral wall 12*a* to which the base ends 13*a* are connected. In intermediate parts in the direction of width of the lock arms 13, slits 17 are formed that continuously extend from end faces of the base ends 13*a* of the lock arms 13 to parts before ends. Thus, engaging parts 14 are ensured at the ends of the lock arms 13.

Namely, base ends 17*a* of the slits 17 are opened to the end faces of the base ends 13*a* of the lock arms 13 and front ends 17*b* of the slits 17 stop before the ends of the lock arms 13. Inner end faces of the engaging parts 14 are prescribed by the front ends 17*b*. Further, at both outer sides in the direction of width of the ends of the lock arms 13, lock arm regulating protrusions 15 protrude.

On the other hand, in the inner wan of the fitting hood part 9, temporary engaging recessed parts (first engaging parts) 19 are provided that allow the lock arm regulating protrusions 15 to retreat when the movable guide member 11 is located in the temporary engaging position so as to displace the lock arms 13 and are engaged with the lock arm regulating protrusions 15 to prevent the movable guide member 11 from moving and slipping out (being detached) from the fitting hood part 9.

Further, as shown in FIG. 10, in outer side surfaces of the male type connector 5, engaging protrusions (second engaging parts) 21 are provided that press the lock arms 13 when the male type connector is fitted to the female type connector to retreat the lock arm regulating protrusions 15 to the temporary engaging recessed parts 19 and are engaged with the slits 17 of the lock arms 13.

Further, as shown in FIG. 7 and FIG. 8, the movable guide member 11 is provided with engaging arms 31. In the connector main body 7 of the female type connector 3, temporary engaging parts 33 are provided that are respectively engaged with the engaging arms 31 to temporarily engage the movable guide member 11 when the movable guide member 11 is located at the temporary engaging position.

Further, in the inner wall of the fitting hood part 9, lock arm displacement regulating ribs 23 are provided that come into contact with the lock arm regulating protrusions 15 while the movable guide member 11 is returned from the main engaging position to the temporary engaging position through the male type connector 5 to prevent the lock arms 13 from being displaced outward, prevent the engagement of the engaging protrusions 21 with the slits 17 from being released due to the displacement and prevent the movable guide member 11 from being left behind parts (intermediate positions) before the temporary engaging position due to the disengagement.

Now, a method for forming the movable guide member will be described below.

Ordinarily, as shown in FIG. 3, when parts such as the movable guide member 11 that includes the substantially plate shaped main body part 12 and the lock arms 13 provided on the peripheral edges of the main body part 12 which protrude in the vertical direction of the main body part 12 is molded with a resin, the parts is formed by opening and closing forward and backward a combination of a metal mold of a front surface side that forms the front surface side of the main body part 12 and a metal mold of a rear surface side that forms the rear surface side. However, when the slits 17 passing through rightward and leftward are formed as in the above-described lock arms 13, since the slits 17 serve as undercut parts, the slits 17 as the undercut parts cannot be formed only by the metal mold of the front surface side and the metal mold of the rear surface side. A slide core moving rightward and leftward is ordinarily used as well as the metal mold of the front surface side and the metal mold of the rear surface side to form the slits.

However, when such a slide core is used, the structure of the metal mold is complicated and the cost of a molded product is inconveniently high.

Thus, in the exemplary embodiment of the present invention, as shown in FIG. 4, the slits 17 are continuously formed from the end faces of the base ends 13*a* of the lock arms 13 to the parts before the ends of the lock arms 13 to eliminate the undercuts. Accordingly, a slit forming part K is formed in the metal mold of the rear surface side, so that the slits 17 may be formed only by the forward and backward movement of the metal mold of the front surface side and the metal mold of the rear surface side. Thus, the structure of the meal mold can be prevented from being complicated. As a result, the cost of the molded product can be lowered. Here, an arrow mark X shows a moving direction of the slit forming part K when the mold is closed.

When the movable guide member 11 is formed only by the metal mold of the front surface side and the metal mold of the rear surface side, in order to completely and clearly open the slits 17 by the slit forming part K provided in the metal mold of the rear surface side, not only a butting surface Nb of an end of the slit forming part K needs to be provided in an inner end face of the engaging part 14 of the end of the lock arm 13, but also a butting surface Nb of the metal mold needs to be ensured in the peripheral wall 12*b* (12*a*) to which the base end of the lock arm 13 is connected. Especially, to ensure the butting surface Nb in the peripheral wall 12*a* side, since a necessary butting amount S needs to be estimated, the part of the peripheral wall 12*b* to which the base end 13*a* of the lock arm 13 is connected may possibly decrease its thickness. Assuming that the thickness of an original peripheral wall 12*a* is t, the thickness of the part of the peripheral wall 12*b* to which the base end 13*a* of the lock arm 13 is connected is thin such as t1 (<t). When the peripheral wall is partly thinned (the part of the peripheral wall 12*b*) due to the decrease of the thickness, that part is weak in its strength. Thus, the support strength of the lock arms 13 is inconveniently deteriorated.

Thus, in a method for forming the movable guide member 11 according to the exemplary embodiment of the present invention, as shown in FIG. 5, the lock arms 13 are formed so as to have shapes more obliquely curved outward toward the ends of the lock arms 13 and the slits 17 are formed by the slit forming part K provided in the metal mold of the rear surface side. At that time, the butting surface Nb of the end of the slit forming part K is provided in the inner end face of the engaging part 14 of the end of the lock arm 13, and the butting surface Nb of the metal mold is ensured in an outer surface of the peripheral wall 12*b* (12*a*) to which the base end of the lock arm 13 is connected.

In such a way, especially, the butting amount S necessary for forming the engaging parts 14 of the ends of the lock arms 13 with good accuracy is sufficiently maintained, and the decrease of the thickness of the peripheral wall 12*b* for supporting the base ends of the lock arms 13 can be avoided at the same time. That is, the thickness t2 of the peripheral wall 12*b* for supporting the base ends of the lock arms 13 can be ensured, which is same as the thickness t of other part of the peripheral wall 12*a*. Consequently, the deterioration of the support strength of the lock arms 13 can be prevented.

As described above, when the movable guide member 11 is formed by giving a curvature to the lock arms 13, the molded product having such a shape as shown in FIG. 6 is formed. Since the movable guide member 11 is accommodated in the fitting hood part 9 of the female type connector 3 and used, even when the lock arms 13 are slightly curved outward, a functional problem does not occur. Further, when the lock arms 13 are formed in the shapes of a cantilever type, the lock arms 13 may occasionally tend to be curved inward. Thus, even when the lock arms 13 have a curvature during a stage of formation, the curvature may be possibly eliminated during a use. In such a case, there is no fear that a problem may occur in use.

Now, an operation will be described below.

As shown in FIGS. 8 to 10, before the male type connector 5 is fitted to the female type connector 3, the movable guide member 11 is located in the temporary engaging position of the fitting hood part 9 to support the end parts of the male terminals and position the male terminals.

From this state, as shown in FIGS. 11 and 12, when the male type connector 5 is introduced to the fitting hood part 9 of the female type connector 3, the engaging protrusions 21 of the male type connector 5 start to press the lock arms 13 outward. Further, when the male type connector 5 is pushed, the engaging protrusions 21 press the lock arms 13 to engage the lock arm regulating protrusions 15 with the temporary engaging recessed parts 19. Subsequently, when the male type connector 5 is further pushed, as shown in FIG. 13, the engaging protrusions 21 of the male type connector 5 are engaged with the slits 17 of the lock arms 13. Thus, the male terminals start to be fitted to the female terminals and the male type connector 5 comes into contact with the movable guide member 11. Finally, as shown in FIG. 14, the movable guide member 11 is pressed to the main engaging position from the temporary engaging position to complete a fitting operation of the male terminals to the female terminals.

In the fitting process, in the temporary engaging position, the engaging arms 31 of the movable guide member 11 are engaged with the temporary engaging parts 33 of the fitting hood part 9 to hold the movable guide member 11 at the temporary engaging position and more improve a positioning function of the male terminals and the female terminals. Further, when the engaging protrusions 21 of the male type connector 5 engage the lock arm regulating protrusions 15 with the temporary engaging recessed parts 19, the movable guide member 11 is prevented from moving to the main engaging position side by the engagement of the engaging arms 31 with the temporary engaging parts 33.

Further, when the fitting state of the male terminals and the male terminals is released, as shown in FIG. 15, the male type connector 5 moved to the opening side of the fitting hood part 9 releases the fitting state of the male terminals and the female terminals to allow the engaging protrusions 21 to come into contact with the lock arms 13 and starts to move the movable guide member 11 to the engaging position side. Then, when the male type connector 5 is further pulled out, as shown in FIGS. 16 to 18, the movable guide member 11 is moved to the temporary engaging position and the engaging protrusions 21 start to press the lock arms 13. Further, the engaging protrusions 21 displace the lock arms 13 to engage the lock arm regulating protrusions 15 with the temporary engaging recessed parts 19. The engagement of the engaging protrusions 21 with the lock arms 13 is released due to the displacement of the lock arms 13. The male type connector 5 leaves the movable guide member 11 in the temporary engaging position and independently moves to the opening side of the fitting hood part 9 so as to be pulled out.

As described above, the male type connector 5 can be smoothly fitted to the female type connector 3 by the operation of the movable guide member 11. When the fitting state of the male type connector and the female type connector is released, the movable guide member 11 can be automatically held at a position for a next fitting operation.

What is claimed is:

1. Resin molded parts, comprising:

a main body part; and belt plate shaped lock arms, connected to peripheral edges of the main body part with base ends connected to the peripheral edges of the main body part and ends protruding toward a front side vertical to the main body part, the lock arms having slits which are formed in intermediate parts of the lock arms in the direction of width of the lock arms and extend from the base ends of the lock arms to parts before the ends to ensure engaging parts in the ends of the lock arms, base ends of the slits being opened to end faces of the base ends of the lock arms;

wherein a peripheral wall protruding toward a rear side vertical to the main body part is connected to the peripheral edge of the main body part, the lock arms are connected to the outer surfaces of the peripheral wall by connecting the base ends to the outer surfaces of the peripheral wall and the slits are continuously formed from the end faces of the base ends of the lock arms to the parts before the ends of the lock arms.

2. The resin molded parts of claim 1, wherein a connector uses the resin molded parts, the connector comprising:

a male type connector in which female terminals are incorporated;

a female type connector having male terminals incorporated which are connected to the female terminals and a hood part for receiving the male type connector in a front part; and a movable guide member accommodated in the hood part and configured to slide in a moving direction of the male type connector, located at an initial position in a front side before the male type connector is fitted to the female type connector to protect protruding ends of the male terminals; and pressed by the male type connector to move to a rear side as the male type connector is fitted to the female type connector to guide the connection of the male terminals to the female terminals in the male type connector, wherein the movable guide member is provided with lock arms having slits, first engaging parts are provided on the wall surfaces of the hood part of the female type connector that are engaged with the lock arms to prevent the movable guide member from being detached from the female type connector and second engaging parts are provided in the male type connector that are engaged with the slits of the lock arms, and the resin molded parts are used as the movable guide member.

* * * * *